United States Patent [19]

Knight

[11] 4,344,542

[45] Aug. 17, 1982

[54] RAILWAY GANG CAR COUPLER

[76] Inventor: Pete L. Knight, 2036 Mustang La., Arcata, Calif. 95521

[21] Appl. No.: 168,510

[22] Filed: Jul. 14, 1980

[51] Int. Cl.[3] ..... B61G 1/14; B61G 5/00; B61G 7/00

[52] U.S. Cl. ..... 213/188; 213/75 R; 213/90; 213/98; 213/175; 213/213; 213/217

[58] Field of Search ..... 213/75 R, 79, 85, 86, 213/89, 98, 99, 175, 188, 90, 213, 217, 218, 219

[56] References Cited

U.S. PATENT DOCUMENTS

| | | | |
|---|---|---|---|
| 286,061 | 10/1883 | Payne | 213/175 |
| 401,854 | 4/1889 | Poffenbarger | 213/89 |
| 409,420 | 8/1889 | Newman | 213/98 |
| 601,483 | 3/1898 | Siddall | 213/98 |
| 2,096,644 | 10/1937 | Montgomery et al. | 213/175 |
| 2,443,629 | 6/1948 | Matuszewski | 213/75 R X |

*Primary Examiner*—Joseph F. Peters, Jr.

*Assistant Examiner*—Howard Beltran

*Attorney, Agent, or Firm*—Melvin R. Stidham

[57] ABSTRACT

A coupling device for railway motor cars includes a pole or tongue on the motor car with a cam member pivoted on the distal end thereof. A coupling box with converging side walls is secured to the end of the trailing car and has a coupling pin extending from top to bottom. When the pivoted cam enters the box it is cammed by first, a sidewall, and then the back wall to pivot and hook around the coupling pin. During the course of this movement, a spring-biased locking pin rides on the flat, top surface of the cam to drop behind it when the coupling is complete, thus preventing reverse pivotal movement. A chain, is secured from the locking pin to an arm extending radially from a long shaft extending laterally to the side of motor car and terminating in an operating arm which, when raised, lifts the locking pin to release the pivoted cam for uncoupling.

3 Claims, 4 Drawing Figures

RAILWAY GANG CAR COUPLER

BACKGROUND OF THE INVENTION

In the past, the coupling and uncoupling of railway cars usually required a trainman to stand between the cars to effect the locking and releasing operations. In recent years, conventional railway cars have been supplied with automatic coupling devices which enable the connection and disconnection to be completed without direct manual operation. Now, the Railway Safety Rules of the Department of Transportation have been extended to require that track motor cars, which are used to carry track maintenance crew and equipment, be provided with couplers which can be coupled and uncoupled without requiring one to go between the ends of the cars.

OBJECTS OF THE INVENTION

It is an object of this invention to provide a simple and inexpensive car coupling device which can be coupled automatically and released conveniently, without exposing a crewman to danger.

It is a further object of this invention to provide an inexpensive and effective coupling device for rail motor cars.

It is a further object of this invention to provide a railway coupling device which is efficient and economically feasible.

Other objects and advantages of this invention will become apparent from the description to follow, particularly when read in conjunction with the accompanying drawings.

SUMMARY OF THE INVENTION

In carrying out this invention, I provide for the pulling car a rearwardly extending pole or tongue having a cam member pivoted on the end thereof. The cam member has a recess on the inboard side thereof to receive a coupling pin that extends from top to bottom on a coupling box carried at the forward end of the pulled car. The coupling box has converging side walls which are engaged by a cam surface on the outboard side of the cam member to pivot the cam member in and around the coupling pin as the tongue advances into the coupling box. A spring biased locking pin rides on the surface of the cam and then drops behind it when it is pivoted into full coupling position. A cable or a chain is connected between the top of the locking pin and a release arm which extends radially from a long axle that extends across the rear end of the motor car and then it extends radially at the side of the car, to form an operating arm. Hence, by raising the operating arm, a crewman can raise the chain and locking pin without stepping between the ends of the cars.

DESCRIPTION OF A PREFERRED EMBODIMENT

Figure 1:
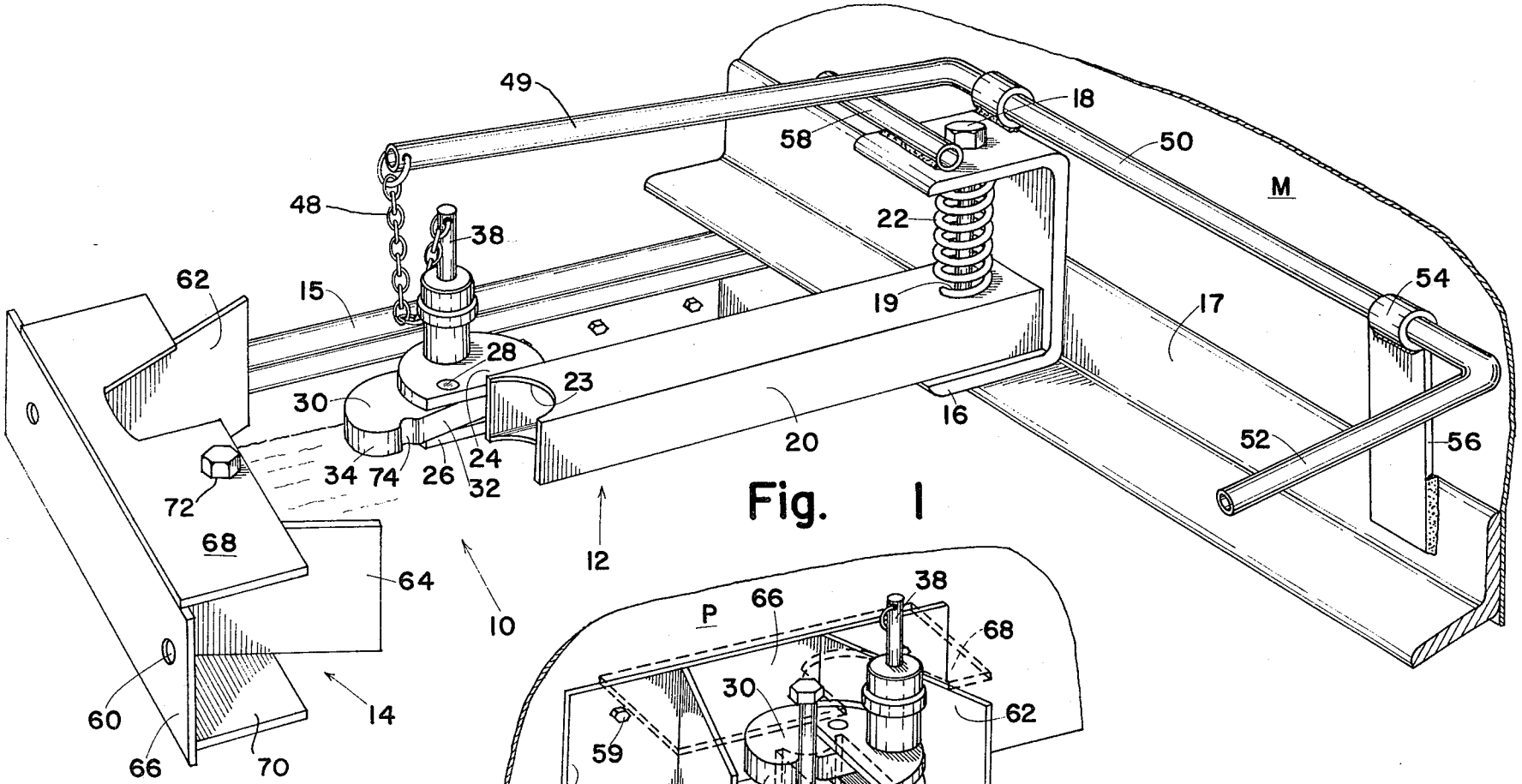
FIG. 1 is a view in perspective showing the coupling device of this invention preparatory to coupling.

Referring now to FIG. 1 with greater particularity, the coupling device 10 of this invention includes a male coupling assembly 12 and a female component 14. The coupling device 10 is particularly adapted for motorized track cars of the type used to convey crew and material to a job site for maintenance of the railway tracks 15. The male assembly 12 is supported on a mounting bracket 16 carried on a base member 17 which is welded or otherwise secured to the motorized cam M. A bolt 18 on the bracket 16 extends loosely through an enlarged opening 19 in the trailing end of a pole or tongue 20 to enable a limited amount of play which is dampened by a spring 22. The leading end of the tongue 20 recessed at 23 for a purpose to be described.

At the end of the tongue 20 are welded spaced, top and bottom cam base plates 24 and 26, carrying a pin 28 between them on which is pivotally mounted the cam member 30. The cam member 30 has a relatively straight inboard edge 32 and a curved cam surface 34 at the leading and outboard edges.

Figure 2:
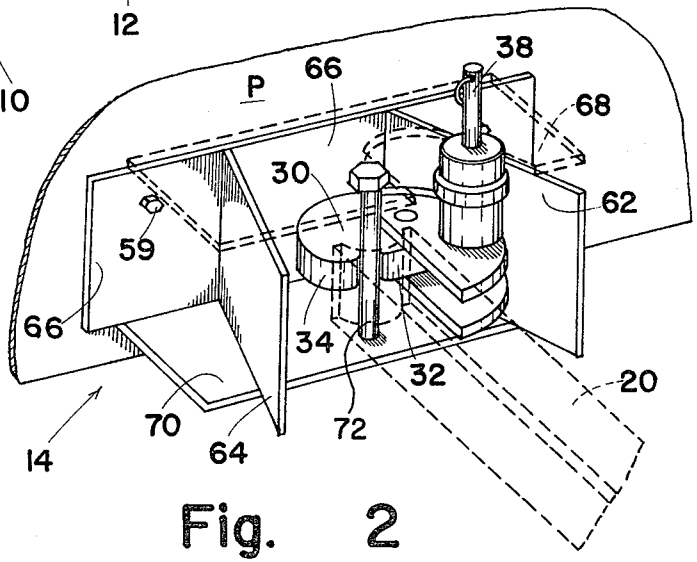
FIG. 2 is a partial view in perspective showing the coupling spear entering the coupling box.
Figure 4:
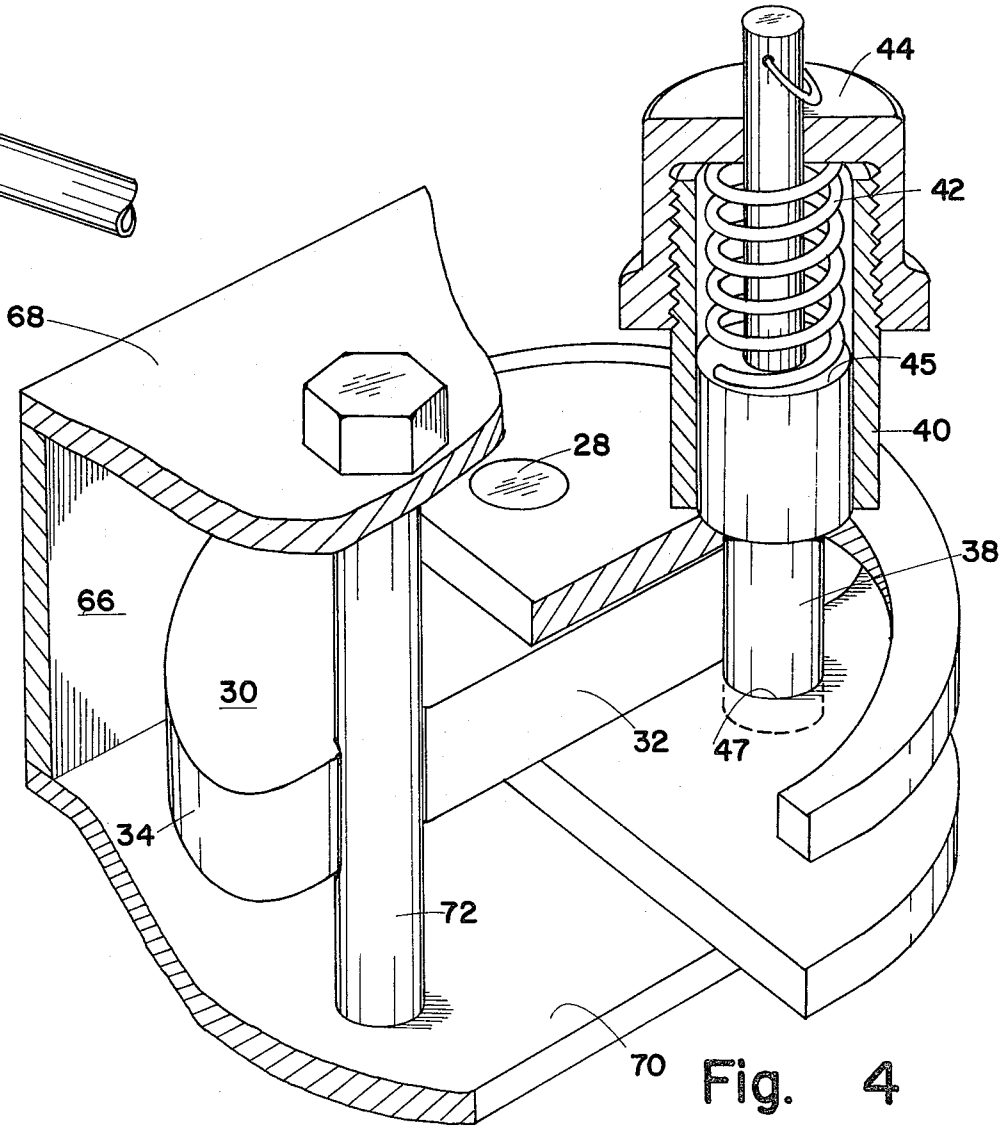
FIG. 4 is an enlarged partial view showing the coupling device with locking pin in place.
Figure 3:
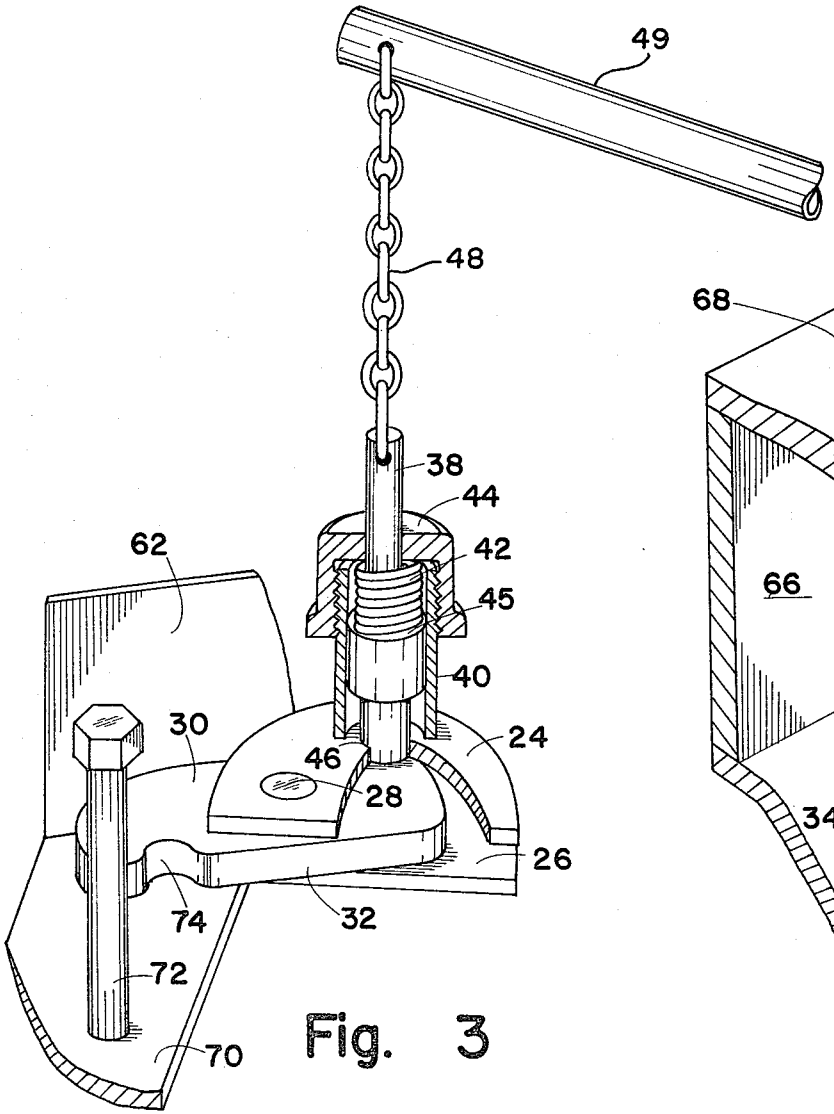
FIG. 3 is an enlarge view in perspective showing the coupling cam and blocking pin.

As best shown in FIGS. 3 and 4, a blocking pin 38 is slidably carried in a spring retainer cup 40 which carries a compression spring 42 biasing between the crown 44 of the retainer case 40 and a shoulder 45 on the locking pin 38. The locking pin 38 is slidable in a hole 46 in the upper cam base plate 24 (FIG. 3) and is adapted to be received in an aligned hole 47 or the lower base plate. Prior to coupling the locking pin 38 merely rides on the top surface of the cam 30, but when the cam member 30 pivots fully to the position shown in FIGS. 2 and 4, the spring drives the lock pin 38 down to engage in the lower hole 47 and lock the cam member 30 against return movement.

A suitable tension member, such as a cable or chain 48, is connected between the top of the locking pin 38 and a radial arm 49 which is carried on a long shaft 50 that extends across the front of the motorized car T to the side, where it terminates in another radial arm 52, the hand operating arm. The shaft 50 is rotatably carried in bearings 54 supported on brackets 56 welded to the base member 17 and, between coupling operations, is supported on an arm rest 58 which is welded to the bracket 16. Hence, it will be apparent, that by lifting the operating arm 52 from the side of the car, the chain 48 will lift the lock pin 38 to the position shown in FIG. 3 wherein the cam 30 is free to pivot.

The female component 14 of the coupling assembly 10 is secured to the trailing car P, as by means of bolts 59 extending through holes 60. Female coupling element 14, which has converging sidewalls 62 and 64, a back wall 66 and top and bottom walls 68 and 70 between which a coupling pin 72 extends.

The converging sidewall 62 is so disposed that as the cam 30 enters the box 62 the forward camming face 34, engages it, as shown in FIG. 3, and causes it to pivot inboard from the position shown in FIG. 1, pivoting it around behind the coupling pin 72 as the locking pin 38 rides on its top surface. This action continues as the camming surface 34 engages the back wall 66, in which position it is behind the coupling pin 72 whereby the pivoting action is completed and the coupling pin 72 is received in a hook like recess 74 on the cam member 30. The recess 23 at the end of the tongue accommodates the coupling pin 72 allowing the now trailing surface 32 of the cam member to engage. At this point, the relatively straight inboard edge 32 passes beneath the locking pin 38 allowing the spring 42 to drive it down behind the edge to prevent reverse pivotal movement of the cam member 30, as previously described. Hence, inadvertent uncoupling is prevented.

Subsequently, to uncouple the cars, the crewman raises the operating handle 52 to raise the locking pin 38 and the pulling car may simply be moved forward to separate the coupling device 10.

While this invention has been described in conjunction with a preferred embodiment thereof, it is obvious that modifications and changes therein may be made by those skilled in the art to which it pertains without departing from the spirit and scope of this invention as defined by the claims appended hereto.

What is claimed as invention is:

1. A coupling assembly for a pair of railway cars comprising:

a pair of base members adapted to be mounted on a trailing end of a pulling car and a forward end of a pulled car, respectively;

a tongue having an end is carried on one of said base members;

a receptacle is carried on the other of said base members;

said receptacle having an inwardly angled side wall and a transverse back wall;

an upright coupling pin extending across said receptacle from top to bottom;

a cam member pivoted on the end of said tongue;

a hook-like recess on one side of said cam member of a size to nest around said lock pin;

a cam surface across a leading end and other side of said cam member adapted to engage said side and back walls to pivot said cam member around behind said coupling pin into engagement therewith;

a spring-biased lock pin carried on said tongue to ride on the top surface of said cam member adjacent the trailing edge thereof until one edge passes therebeneath;

a shaft rotatable on said one base member;

a release arm on one end of said shaft;

an operating lever on the other end of said shaft; and a tension member secured between said release arm and said lock pin so that upward pivotal movement of said lever will lift said lock pin.

2. The coupling defined by claim 1 including:

top and bottom cam base plates secured to the end of said tongue;

said cam member being pivoted therebetween;

a spring support welded to said top plate;

said lock pin being slidably carried on said support to extend thereabove;

a shoulder on said lock pin; and a spring on said shoulder compressing against said spring support.

3. The coupling defined by claim 2 wherein:

said spring support is a cylinder.

* * * * *